US006807816B2

(12) United States Patent
Lee et al.

(10) Patent No.: US 6,807,816 B2
(45) Date of Patent: Oct. 26, 2004

(54) AIR CONDITIONING SYSTEM WITH TWO COMPRESSORS AND METHOD FOR OPERATING THE SAME

(75) Inventors: Won Hee Lee, Seoul-si (KR); Chang Min Choi, Seoul-si (KR); Yoon Jei Hwang, Seoul (KR); Deok Huh, Buchun-si (KR); Cheol Min Kim, Kwangmyung-si (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/377,877

(22) Filed: Mar. 4, 2003

(65) Prior Publication Data

US 2003/0233838 A1 Dec. 25, 2003

(30) Foreign Application Priority Data

Jun. 19, 2002 (KR) ..... 10-2002-34364

(51) Int. Cl.[7] ..... F25B 7/00; F25B 19/00

(52) U.S. Cl. ..... 62/175; 62/231; 236/1 EA

(58) Field of Search ..... 62/175, 231, 228.1, 62/228.5, 196.1, 196.2, 196.3; 236/1 EA; 417/12

(56) References Cited

U.S. PATENT DOCUMENTS 6,474,083 B2 * 11/2002 Taguchi ..... 62/158 X
6,519,957 B2 * 2/2003 Huh et al. ..... 62/231 X

* cited by examiner

*Primary Examiner*—Harry B. Tanner
(74) *Attorney, Agent, or Firm*—Greenblum & Bernstein, P.L.C.

(57) ABSTRACT

Disclosed are an air conditioning system with two compressors so as to shorten standby time for re-operating a stopped compressor and variably change the compression capacity of a refrigerant according to cooling load, and a method for operating the air conditioning system. The method for operating the air conditioning system with two compressors, comprises the first step of simultaneously operating the compressors regardless of cooling load at an early stage of the operation, the second step of selectively operating one of the compressors according to the cooling load, and the third step of additionally re-operating the stopped compressor when the operated compressor selected from the compressor in the second step is continuously operated for longer than a designated time, thereby shortening the standby time for re-operating the stopped compressor, rapidly changing the compression capacity of the refrigerant according to the cooling load, and improving users' comfort within a room.

4 Claims, 5 Drawing Sheets

AIR CONDITIONING SYSTEM WITH TWO COMPRESSORS AND METHOD FOR OPERATING THE SAME

BACKGROUND OF THE INVENTION

1. Field of the Invention

The present invention relates to an air conditioning system with two compressors and a method for operating the same, and more particularly to an air conditioning system with two compressors, so as to shorten standby time for re-operating a stopped compressor, and a method for operating the air conditioning system.

2. Description of the Related Art

Generally, an air conditioner comprises a compressor for compressing a gaseous refrigerant in a low-temperature and low-pressure state so as to convert it into a high-temperature and high-pressure state, a condenser for condensing the gaseous refrigerant in the high-temperature and high-pressure state compressed by the compressor so as to convert it into a liquid refrigerant in a high-temperature and high-pressure state, and an evaporator for evaporating the liquid refrigerant in the high-temperature and high-pressure state condensed by the condenser so as to convert it into a gaseous refrigerant in a low-temperature and low-pressure state. A heat pump air conditioner, additionally having a heating function, further comprises a four-way valve for converting a flow direction of the refrigerant according to cooling and heating modes.

In such a heat pump air conditioner, an indoor heat exchanger and an outdoor heat exchanger have different functions according to their cooling and heating modes. That is, the indoor heat exchanger serves as the condenser and the outdoor heat exchanger serves as the evaporator in the heating mode, thereby forming a heating cycle. On the other hand, the indoor heat exchanger serves as the evaporator and the outdoor heat exchanger serves as the condenser in the cooling mode, thereby forming a cooling cycle. Therefore, the heat pump air conditioner is unlimitedly applicable in all seasons.

Hereinafter, the air conditioner for forming the cooling cycle and the heat pump air conditioner for forming the cooling and heating cycles are generally referred to as an air conditioner.

Recent, air conditioners employ a plurality of compressors having different capacities, thereby variably changing a compression capacity of the refrigerant and optimizing cooling and heating efficiencies.

FIG. 1 is a block diagram illustrating a flow of a refrigerant of a conventional air conditioner in a cooling mode, and FIG. 2 is a graph illustrating operating states of compressors in the conventional air conditioner. With reference to FIGS. 1 and 2, a method for operating the conventional air conditioner is described, as follows.

FIG. 1 is a block diagram illustrating the flow of the refrigerant of the conventional air conditioner in the cooling mode. The conventional air conditioner comprises a plurality of compressors 10 for compressing a gaseous refrigerant in a low-temperature and low-pressure state so as to convert it into a high-temperature and high-pressure state. The compressors 10 includes first and second compressors 11 and 12, having different compression capacities of the refrigerant.

Each of the first and second compressors 11 and 12 has a designated compression capacity of the refrigerant, so as to compress a specific percentage of the total capacity (100%) of the refrigerant. The compression capacities of the refrigerant of the first and second compressors 11 and 12 are set by a manufacturer. Herein, the first compressor 11 has a 60% compression capacity of the refrigerant, and the second compressor 12 has a 40% compression capacity of the refrigerant.

Therefore, the total compression capacity of the refrigerant in the air conditioner is variably changed by selectively or simultaneously operating the first compressor 11 and the second compressor 12 according to a cooling load.

The conventional air conditioner further comprises check valves 13 and 14, a four-way valve 20, an outdoor heat exchanger 30, an expansion valve 40, an indoor heat exchanger 50, and an accumulator 60, thereby forming a cooling cycle via a flow of the refrigerant. The check valves 13 and 14 respectively prevent the reverse-flow of the refrigerant compressed by the first and second compressors 11 and 12. The four-way valve 20 converts the flow direction of the refrigerant passing through the first and second compressors 11 and 12, thereby reversing functions of the outdoor and indoor heat exchangers 30 and 50. The outdoor heat exchanger 30 exchanges heat between external air and the refrigerant, thereby condensing the gaseous refrigerant in the high-temperature and high-pressure state, so as to convert it into a liquid refrigerant in a mid-temperature and high-pressure state. The expansion valve 40 decompresses the liquid refrigerant passing through the outdoor heat exchanger 30, so as to convert it into a low-temperature and low-pressure state. The indoor heat exchanger 50 exchanges heat between the indoor air and the refrigerant passing through the expansion valve 40 so as to convert it into a two-phase refrigerant in liquid and gaseous phases. The accumulator 60 separates the liquid phase from the two-phase refrigerant passing through the indoor heat exchanger 50, and then supplies only the gaseous phase to the first and second compressors 11 and 12.

When the cooling or heating load is relatively light, only the second compressor 12 of the air conditioner is operated. Herein, the first compressor 11 is stopped, and the check valve 13 of the first compressor 11 is closed.

Therefore, the gaseous refrigerant compressed in the high-pressure state, which is discharged from an outlet 11*b* of the first compressor 11 and then supplied to the check valve 13, is cut off, and then high pressure at the outlet 11*b* of the first compressor 11 is maintained. Since the gaseous refrigerant at an inlet 11*a* of the first compressor 11 is not yet compressed, low pressure at an inlet 11*a* of the first compressor 11 is maintained. Therefore, a pressure difference between the inlet 11*a* and the outlet 11*b* of the compressor 11 is generated.

When the pressures at the inlet 11*a* and the outlet 11*b* of the compressor 11 are equalized so as to remove the pressure difference, the stopped compressor 11 is re-operated. Standby time for re-operating the stopped compressor 11 is the same as the time taken to equalize the pressures at the inlet 11*a* and the outlet 11*b* of the compressor 11.

When the high-pressure refrigerant around the outlet 11*b* moves toward the inlet 11*a* during the pressure equilibrium time, so as to equalize the pressures at the inlet 11*a* and the outlet 11*b* of the compressor 11, oil used to operate the first compressor 11 leaks via gaps formed through the first compressor 11 and is accumulated in a pipe (P1) connected to the inlet 11*a*. When the first compressor 11 is re-operated and the refrigerant flows into the first compressor 11 via the inlet 11*a*, the leaking oil accumulated in the pipe (P1) flows into the first compressor 11, together with the refrigerant.

However, when the first compressor 11 is stopped for a long time, the leaking oil accumulated in the pipe (P1) is solidified and an inner surface of the pipe (P1) becomes uneven. The uneven inner surface of the pipe (P1) with the solidified oil obstructs the flow of the refrigerant to re-operate the first compressor 11, thereby extending the standby time for re-operating the stopped compressor 11. Further, when the standby time is extended, the air conditioner cannot rapidly cope with the variation of the cooling load, thereby not satisfying users' comfort requirement within a room.

With reference to FIG. 2, the operating states of the compressors of the conventional air conditioner is described as follows.

When a cooling order is inputted to the air conditioner and the compressors are operated, the second compressor having the 40% compression capacity of the refrigerant is first operated, and later the first compressor having the 60% compression capacity of the refrigerant is additionally operated. Then, the total compression capacity of the refrigerant becomes 100% (F1) and a cooling cycle starts so that the room temperature reaches a desired temperature.

When the room temperature reaches the desired temperature, the compressors are stopped. Then, when the room temperature rises, the compressors are simultaneously operated again so as to lower the room temperature, and later only one compressor is continuously operated so as to maintain the lowered room temperature. Herein, the second compressor is continuously operated and the first compressor is stopped for a long time (PT).

In order to satisfy an increased cooling load, the stopped first compressor must be additionally re-operated together with the second compressor. At this time, standby time for re-operating the stopped first compressor is extended due to the above-described problem, and then the increased cooling load is not rapidly satisfied.

SUMMARY OF THE INVENTION

Therefore, the present invention has been made in view of the above problems, and it is an object of the present invention to provide an air conditioning system with two compressors and a method for operating the same, in which standby time for re-operating a stopped compressor is shortened by forcibly operating the stopped compressor regardless of cooling load when the stopped compressor maintains its stopped state for longer than a designated time, thereby rapidly satisfying the variation of the cooling load and improving users' comfort in a room.

In accordance with one aspect of the present invention, the above and other objects can be accomplished by the provision of an air conditioning system with two compressors, comprising:

an air conditioner for conditioning air of a room so as to satisfy cooling load via a cooling cycle formed by a refrigerant passing through compressors, a condenser, an expansion valve, and an evaporator; and a control unit for selectively or simultaneously operating the compressors according to a variation of the cooling load so as to variably control a compression capacity of the refrigerant.

In accordance with another aspect of the present invention, there is provided a method for operating an air conditioning system with two compressors, comprising:

the first step of simultaneously operating the compressors regardless of cooling load at an early stage of the operation;

the second step of selectively operating one of the compressors according to the cooling load; and the third step of additionally re-operating the stopped compressor when the operated compressor selected from the compressor in the second step is continuously operated for longer than a designated time.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Now, preferred embodiments of the present invention will be described in detail with reference to the annexed drawings.

Figure 3:
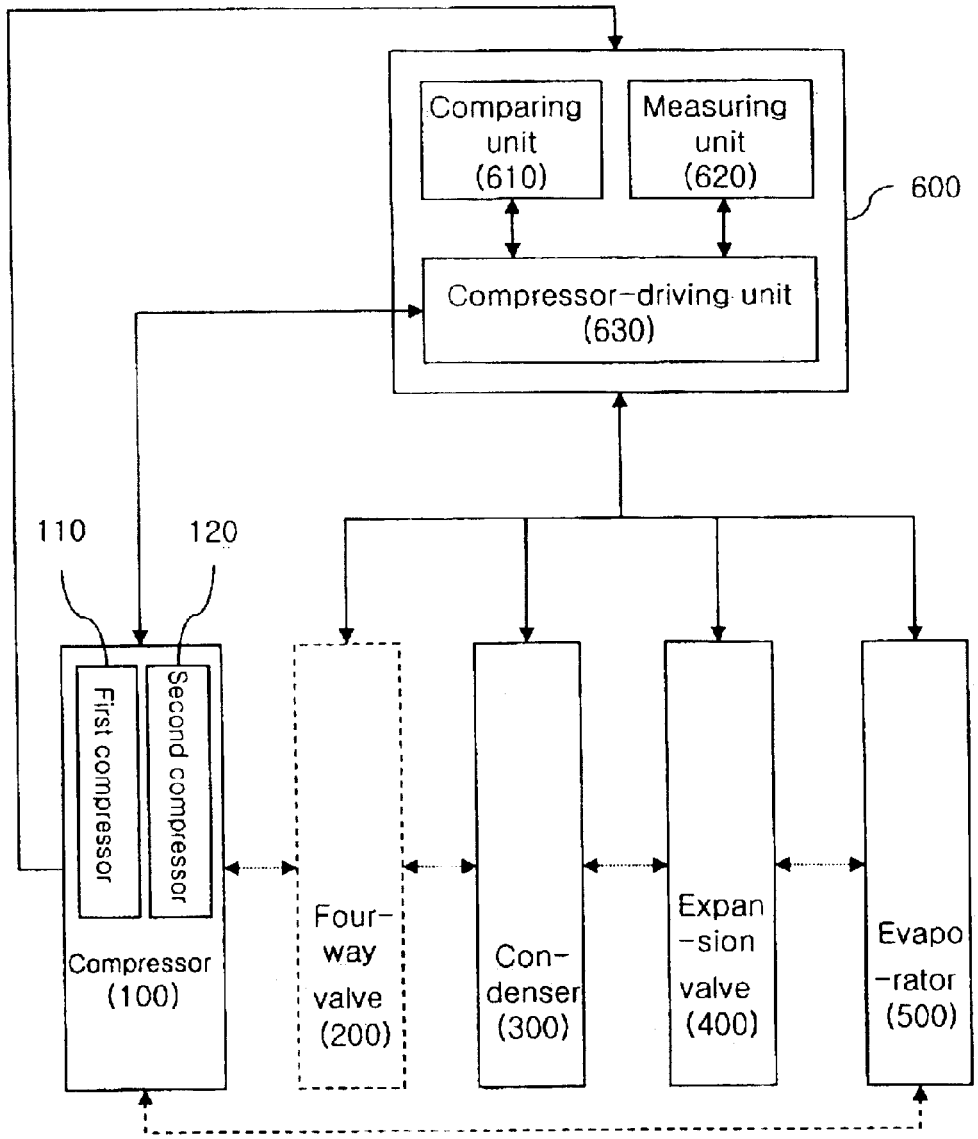
FIG. 3 is a block diagram of an air conditioning system with two compressors in accordance with the present invention.
Figure 4:
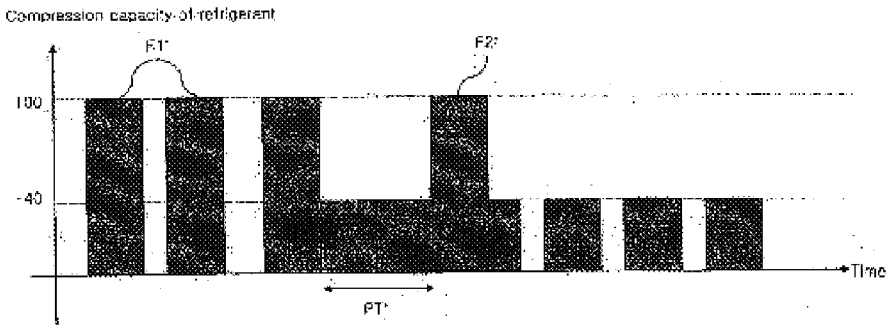
FIG. 4 is a graph illustrating operating states of compressors in the air conditioning system with two compressors in accordance with the present invention.

FIG. 3 is a block diagram of an air conditioning system with two compressors in accordance with the present invention, and FIG. 4 is a graph illustrating operating states of compressors in the air conditioning system with two compressors in accordance with the present invention.

Figure 1:
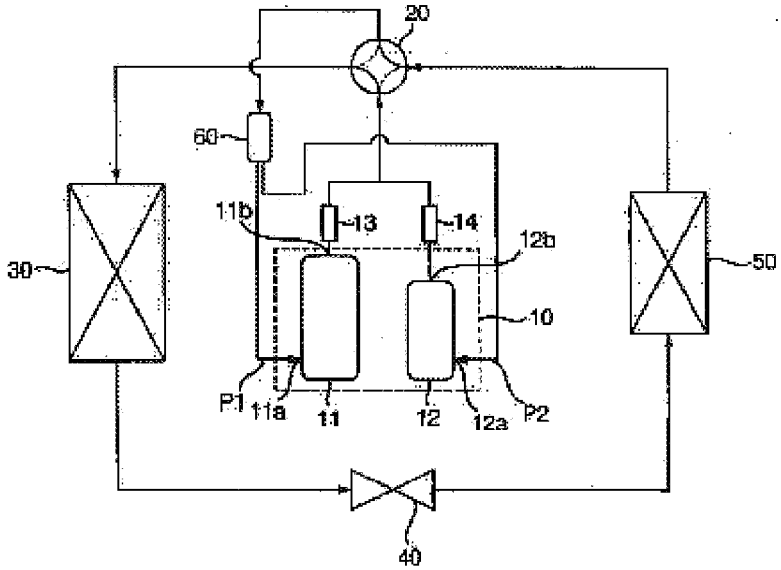
FIG. 1 (Prior Art)
FIG. 1 is a block diagram illustrating a flow of a refrigerant in a conventional air conditioner.
Figure 2:
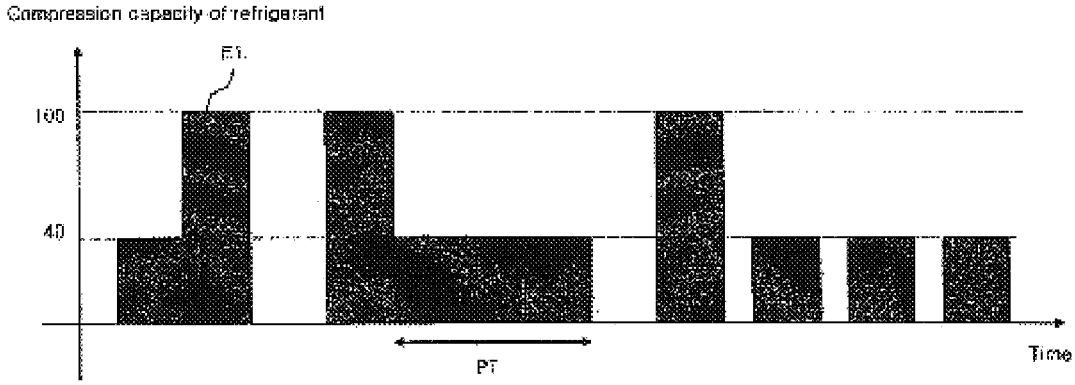
FIG. 2 (Prior Art)
FIG. 2 is a graph illustrating operating states of compressors in the conventional air conditioner.

An air conditioner of the present invention is similar to the conventional air conditioner of FIG. 1. In FIG. 3, a solid arrow denotes a flow of a control signal from a control unit to each component of the air conditioner, and a dotted arrow denotes a flow of a refrigerant between components of the air conditioner. With reference to FIG. 3, the air conditioning system of the present invention is described as follows.

Compressors 100 suck a gaseous refrigerant evaporated by an evaporator, and then compress the sucked gaseous refrigerant so as to convert it into a high-pressure state. Thereby, kinetic energy of the molecules within the gaseous refrigerant is increased, thereby causing collisions between the molecules. Then, energy generated by the collisions between the molecules raises the temperature of the gaseous refrigerant so that the gaseous refrigerant is converted into a high-temperature and high-pressure state. Since the above gaseous refrigerant has an increased number of molecules per unit volume, the gaseous refrigerant is easily liquefied at room temperature.

The compressors 100 of the air conditioning system of the present invention include a first compressor 110 and a second compressor 120. Each of the first and second compressors 110 and 120 has a designated compression capacity of the refrigerant so as to compress a specific percentage of the total capacity (100%) of the refrigerant. Herein, the compression capacities of the refrigerant of the first and second compressors 110 and 120 are set by a manufacturer. In accordance with a preferred embodiment of the present invention, the first compressor 110 has a 60% compression capacity of the refrigerant, and the second compressor 120 has a 40% compression capacity of the refrigerant. However, the compression capacity of each compressor is not limited thereto.

A condenser 300 removes heat from the gaseous refrigerant in the high-temperature and high-pressure state discharged from the compressors 100, thereby liquefying the gaseous refrigerant so as to convert it into a liquid refrigerant in a mid-temperature and high-pressure state.

An expansion valve 400 expands the liquid refrigerant in the mid-temperature and high-pressure state, thereby reducing the pressure of the liquid refrigerant so as to convert it into a low-temperature and low-pressure state.

An evaporator 500 absorbs heat from indoor air, thereby evaporating the liquid refrigerant in the low-temperature and low-pressure state so as to convert it into a gaseous refrigerant in a low-temperature and low-pressure state, thus cooling a room.

A heat pump air conditioner, additionally having a heating function, further comprises a four-way valve 200 represented in a dotted line of FIG. 3. Herein, a control unit 600 controls the four-way valve 200 to convert a circulation direction of the refrigerant according to cooling and heating modes.

The control unit 600 controls the operations of all components, i.e., the compressors 100, the condenser 300, the expansion valve 400, and the evaporator 500 so as to initiate a cooling function. In case of the heat pump air conditioner additionally having heating function, the control unit 600 controls the four-way valve 200 to convert a flow direction of the refrigerant.

The control unit 600 of the air conditioning system comprising the two compressors 110 and 120 of the present invention includes a comparing unit 610, a measuring unit 620, and a compressor-driving unit 630. The comparing unit 610 judges whether the cooling load is heavy or light. The measuring unit 620 measures an operating time of an operated compressor selected from the compressors. The compressor-driving unit 630 outputs a control signal for selectively or simultaneously operating the compressors according to the variation of the cooling load and the operating time.

The comparing unit 610 compares a difference between a desired room temperature and a real room temperature to a reference value, thereby judging whether the cooling load is heavy or light. The measuring unit 620 measures the operating time of the operated compressor selected from the compressors. In case the operating time exceeds a designated time, the non-operated compressor maintains its stopped state for longer than the designated time. Therefore, the measuring unit 620 serves to prevent the extension of standby time for re-operating the stopped compressor when all of the compressors are simultaneously operated according to the heavy cooling load.

Therefore, when the measuring unit 610 judges that the cooling load is heavy, or that the operating time of the operated compressor has exceeded the designated time, the compressor-driving unit 630 outputs a control signal for simultaneously operating the first compressor 110 and the second compressor 120.

Figure 5:
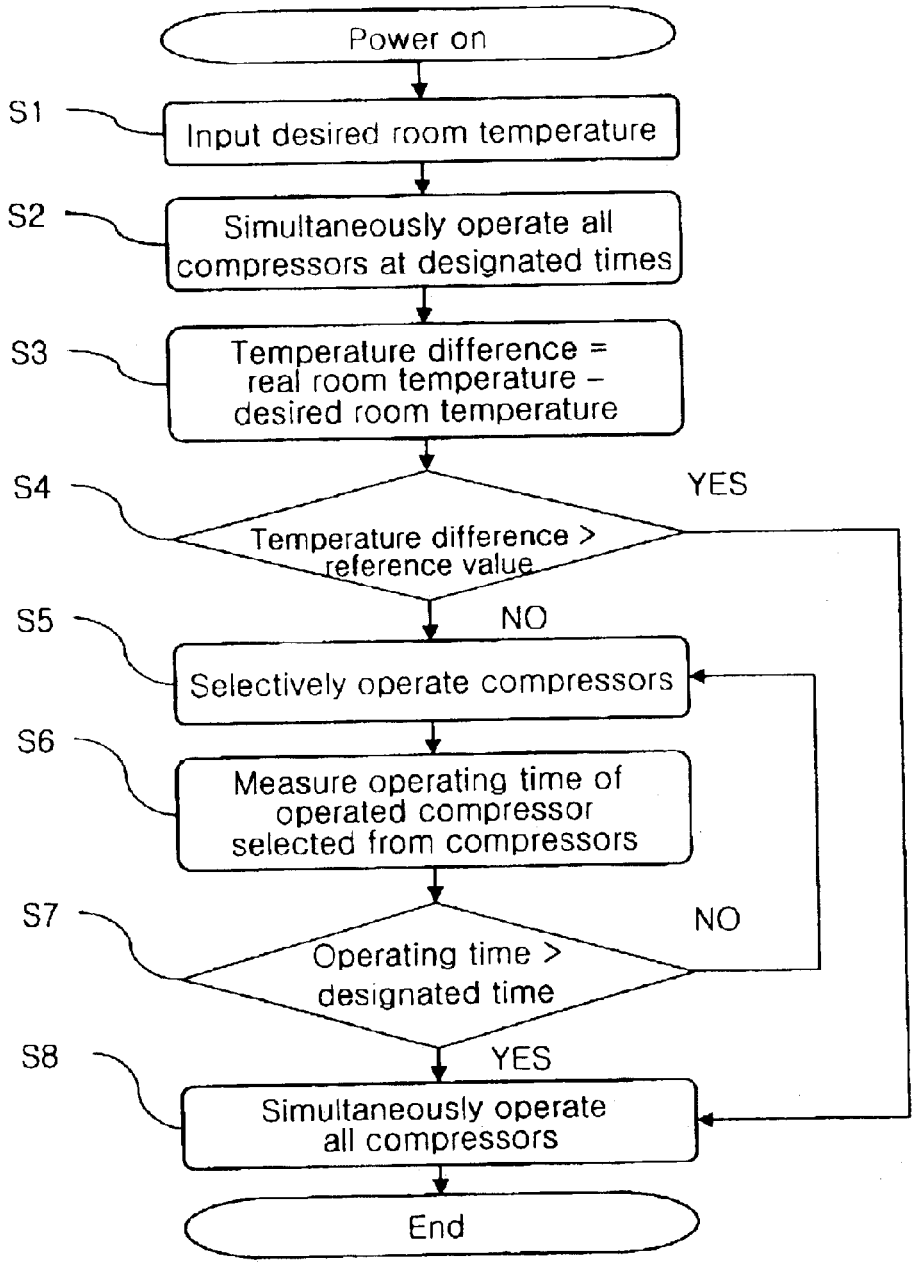
FIG. 5 is a flow chart illustrating a method for operating the air conditioning system with two compressors in accordance with the present invention.

FIG. 4 is a graph illustrating operating states of compressors in the air conditioning system with two compressors in accordance with the present invention, and FIG. 5 is a flow chart illustrating a method for operating the air conditioning system with two compressors in accordance with the present invention. With reference to FIGS. 4 and 5, the method for operating the air conditioning system with two compressors is described in detail as follows.

When a user inputs a desired room temperature into the air conditioning system so as to cool or heat a room (S1), in order to satisfy cooling load according to the desired room temperature, all of the compressors are simultaneously operated (F1') so that the compression capacity of the refrigerant becomes 100%, and the air conditioning system of the present invention discharges cool air via the cooling cycle. Herein, a case of simultaneously operating all of the compressors of the air conditioning system is referred to as a full operation.

The full operation is repeated at designated times so as to rapidly satisfy the cooling load. (S2) In the preferred embodiment of the present invention, the number of times of full operation is predetermined to be twice.

When the room temperature reaches the desired room temperature, the compressors are stopped. Then, the variation of the room temperature is determined. That is, the comparing unit of the control unit obtains a difference between the desired room temperature and the real room temperature (S3), and determines whether the temperature difference exceeds the reference value (S4). When the temperature difference exceeds the reference value, the measuring unit judges that the cooling load is heavy, and when the temperature difference does not exceeds the reference value, the measuring unit judge that the cooling load is light.

The compressor-driving unit of the control unit selectively or simultaneously operates the compressors according to the variation of the cooling load. When the cooling load is heavy, the compressor-driving unit outputs a control signal for simultaneously operating all of the compressors (S8). When the cooling load is light, the compressor-driving unit selectively operates one part of the compressors (S5). That is, in the preferred embodiment of the present invention, only the second compressor is operated and the first compressor is stopped.

The measuring unit of the control unit measures the operating time of the compressor selected from the compressors (S6). When the operating time of the operated compressor exceeds the designated time (PT') (S7), the stopped first compressor is additionally re-operated so that all of the compressors are simultaneously operated (F2') (S8). On the other hand, when the operating time does not exceeds the designated time, only the selected compressor is continuously operated (S5).

Figure 6:
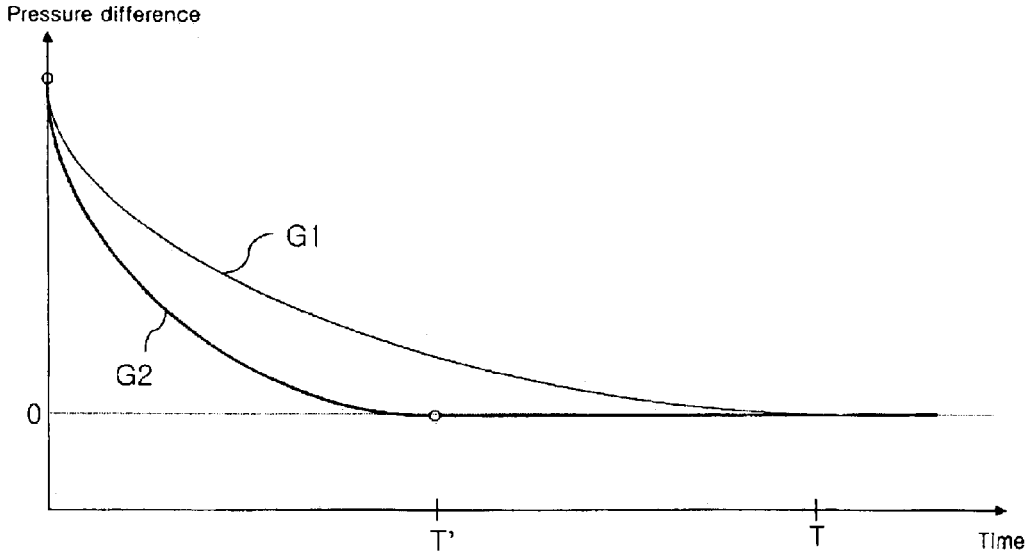
FIG. 6 is a graph illustrating standby times for operating the conventional compressors and the compressors of the present invention.

Therefore, the control unit determines whether the operating time of the operated compressor selected from the compressors exceeds the designated time, and additionally re-operates the stopped compressor according to the determined result so that all of the compressors are simultaneously operated, thereby preventing leaking oil from being accumulated in the pipes of the stopped compressor, and shortening time taken to equalize pressures at an inlet and an outlet of the stopped compressor in the re-operation of the stopped compressor. That is, the conventional pressure equilibrium time (T) is shortened into the pressure equilibrium time (T') of the present invention. A Graph of FIG. 6 comparatively illustrates standby time for re-operating the conventional stopped compressor and standby time for re-operating the stopped compressor of the present invention.

The thin upper curve of FIG. 1 illustrates the conventional pressure equilibrium time (T), and the bold lower curve of FIG. 1 illustrates the pressure equilibrium time (T') of the present invention. The standby time for re-operating the stopped compressor of the present invention is shortened due to the shortened pressure equilibrium time (T').

As apparent from the above description, the present invention provides an air conditioning system with two compressors and a method for manufacturing the air conditioning system, in which the compressors are simultaneously operated so that time for maintaining the stopped state of a stopped compressor does not exceed a designated time, thereby shortening time taken to equalize pressures at an inlet and an outlet of the stopped compressor and then shortening standby time for simultaneously operating the compressors so as to satisfy the increase of a cooling load. Thus, the air conditioning system with two compressors of the present invention rapidly copes with the variation of the cooling load, thereby variably changing a compression capacity of the refrigerant and satisfying the cooling load.

Although the preferred embodiments of the present invention have been disclosed for illustrative purposes, those skilled in the art will appreciate that various modifications, additions and substitutions are possible, without departing from the scope and spirit of the invention as disclosed in the accompanying claims. For example, the compression capacity of each compressor is not limited to the above-described value, but may be variably set by a manufacturer. Further, the above-described technique for shortening standby time for re-operating the stopped compressor when the stopped compressor maintains its stopped state for longer than the designated time may be applied to other fields.

What is claimed is:

1. An air conditioning system with two compressors, comprising:

an air conditioner that conditions air of a room so as to satisfy cooling load via a cooling cycle formed by a refrigerant passing through compressors, a condenser, an expansion valve, and an evaporator; and a control unit that selectively or simultaneously operates the compressors according to a variation of the cooling load so as to variably control a compression capacity of the refrigerant, wherein the control unit comprises:

a comparing unit that judges whether the cooling load is heavy or light;

a measuring unit that measures an operating time of an operated compressor selected from the two compressors; and a compressor-driving unit that outputs a control signal for selectively or simultaneously operating the compressors according to the variation of the cooling load and the operating time, and wherein the compressor-driving unit outputs a control signal that simultaneously operates all of the compressors when the cooling load is increased or when the operating time of the operated compressor exceeds a predetermined time.

2. A method for operating an air conditioning system with two compressors, comprising:

simultaneously operating the compressors regardless of an amount of cooling load at an early stage of the operation;

selectively operating one of the compressors according to the cooling load; and additionally re-operating the stopped compressor when the operated compressor selected from the compressor in the selectively operating is continuously operated for longer than a predetermined time.

3. The method for operating an air conditioning system with two compressors as set forth in claim 2, wherein the selectively operating comprises:

obtaining a difference between a predetermined room temperature and a real room temperature;

comparing the temperature difference obtained by the obtaining to a reference value; and judging that the cooling load is heavy when the temperature difference exceeds the reference value, or judging that the cooling load is light when the temperature difference does not exceed the reference value.

4. The method for operating an air conditioning system with two compressors as set forth in claim 2, wherein the additionally re-operating comprises:

measuring an operating time of the operated compressor selected from the compressors;

comparing the operating time to the designated time; and additionally re-operating the stopped compressor when the operating time exceeds the predetermined time.

* * * * *